US005332217A

United States Patent [19]

Gottlieb

[11] Patent Number: 5,332,217

[45] Date of Patent: Jul. 26, 1994

[54] PINBALL GAME WITH MOVEABLE TRACK MECHANISM

[76] Inventor: Alvin J. Gottlieb, 290 Cottage Hill Ave., Elmhurst, Ill. 60126

[21] Appl. No.: 29,155

[22] Filed: Mar. 10, 1993

[51] Int. Cl.[5] ..... A63F 7/02; A63F 7/36

[52] U.S. Cl. ..... 273/121 A; 273/127 R

[58] Field of Search ..... 273/118–125, 273/127

[56] References Cited

U.S. PATENT DOCUMENTS

| | | | |
|---|---|---|---|
| 2,127,261 | 8/1938 | Kramer et al. | 273/118 A X |
| 3,851,879 | 12/1974 | Hicks | 273/120 R |
| 4,822,045 | 4/1989 | Shoemaker, Jr. | 273/120 A X |
| 4,861,037 | 8/1989 | Oursler | 273/121 A X |
| 5,121,919 | 6/1992 | Martti | 273/121 A X |

*Primary Examiner*—Vincent Millin
*Assistant Examiner*—Raleigh W. Chiu

[57] ABSTRACT

A new pinball game includes a playing surface with a plurality of targets disposed on the playing surface. A player actuated flipper is used to propel a ball toward the targets thereby accumulating points in a first fashion. The pinball game also includes a track which has a first position wherein the ball rolls on the track and a second position wherein the ball is dropped off of the track. A mechanism is provided for positioning the ball on the track. At least one target associated with the track is located below the track. A sensor is connected to the target to detect engagement of the ball with the track associated target. The player actuates a button which causes movement of the track from the first position to the second position thereby dropping the ball off of the track. A memory is provided to store the point value of each track associated target each time such target is hit. The player uses the actuation button to try to drop the ball on or over the target.

12 Claims, 3 Drawing Sheets

PINBALL GAME WITH MOVEABLE TRACK MECHANISM

BACKGROUND OF TEE INVENTION

The present invention relates to a pinball game. More particularly, the present invention relates to a pinball game wherein a ball is rolled down a track and selectively dropped by the player at a predetermined location in order to score points.

For many years, pinball games have provided a source of leisure time enjoyment for people of all ages throughout the world. Typically, when playing pinball, a player sets a ball into play with a spring-biased plunger. The player then earns or scores points depending on the number of times the ball strikes various scoring elements or targets, such as posts, bumpers, slink shot bumpers and pivoting targets disposed across the playing surface. Once the player sets the ball into motion, it randomly strikes the various scoring elements and the player is awarded the point value of each target which is hit by the ball. The pinball playing surface is gently sloped such that the force of gravity constantly urges the ball towards the base of the table where the player is standing. In a typical pinball game configuration, two flippers are mounted near the base of the table. The flippers are electronically actuated by the player by depressing buttons located on the sides of the pinball machine cabinet. By correctly timing actuation of the flippers, the player can cause the flippers to strike the ball and propel it back into the playing area to again contact the various scoring elements.

In order to keep the interest of players, new pinball game configurations must constantly be devised. Usually, a new pinball configuration will consist of providing a new theme and relocating the targets, bumpers and other scoring elements on the playing surface. It is desirable however to provide new pinball configurations wherein the player scores by using nonconventional pinball techniques. Such nonconventional pinball techniques add an additional element of interest to the game.

Therefore it is an object of the present invention to provide a novel pinball game wherein the player may accumulate points by nonconventional pinball scoring techniques.

SUMMARY OF THE INVENTION

To achieve this and other objects of the invention a new pinball game is provided which includes a playing surface with a plurality of targets disposed on the playing surface. A player actuated flipper is used to propel a ball toward the targets thereby accumulating points in a first fashion. The pinball game also includes a track which has a first position wherein the ball rolls on the track and a second position wherein the ball is dropped off of the track. A mechanism is provided for positioning the ball on the track. At least one target associated with the track is located below the track. A sensor is connected to the target to detect engagement of the ball with the track associated target. The player actuates a button which causes movement of the track from the first position to the second position thereby dropping the ball off of the track. A memory is provided to store the point value of each track associated target each time such target is hit. The player uses the actuation button to try to drop the ball on or over the target.

In a second aspect of the invention, the pinball game includes a plurality of targets each of which has a representative game attribute, such as a poker card value. A ball is provided which rolls on a track. The track is configured such that it has a first position wherein the ball rolls on the track and a second position wherein the ball rolls off of the track. The track is disposed above a plurality of sensors, each of which is associated with one of the respective targets. A player actuates movement of the track from the first position to the second position by using an actuation button. The sensors detect when the ball is dropped over a certain target. The pinball game also includes a memory device which has two sets of memory locations. The first set of memory locations stores the value of target attribute which is hit by the ball. The second set of memory locations is used to store the value of a combination of target attributes. In this manner, games such as poker can be played by storing combinations such as a pair, three of a kind, etc. and a certain point value associated with each combination. The player then attempts to drop a ball over a selected card to achieve a particular combination thereby scoring a certain number of points which are added to his pinball score.

These and other features and advantages of the present invention will be further understood from the following detailed description of the presently preferred embodiments of the invention taken in conjunction with the appended drawings and claims.

DETAILED DESCRIPTION OF THE PRESENTLY PREFERRED EMBODIMENTS

The present invention will now be described with respect to the presently preferred embodiments using the Figures. It should be noted that like elements are referred to with like numerals in the various Figures.

Figure 1:
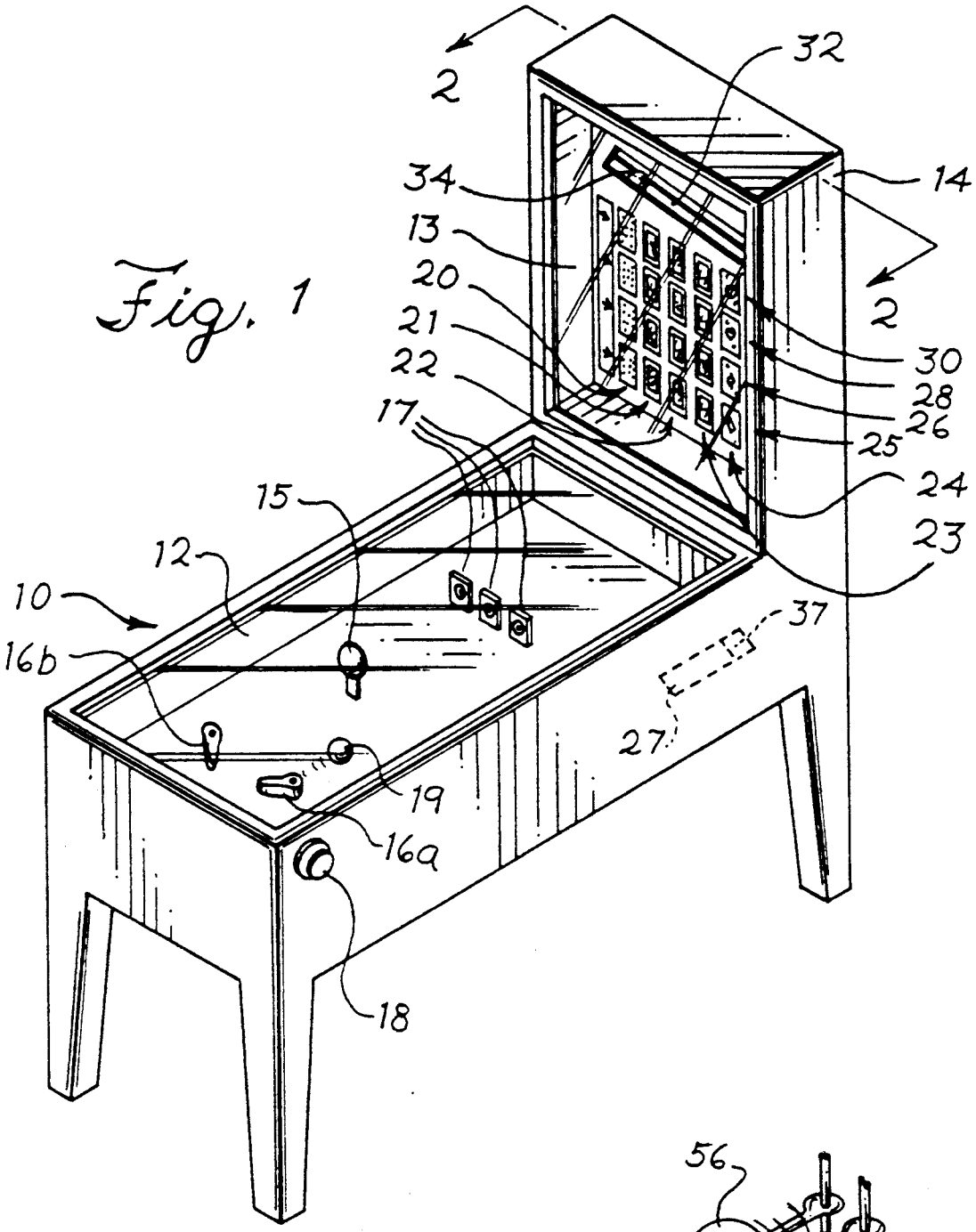
FIG. 1 illustrates a pinball game having an embodiment of the present invention.
Figure 2:
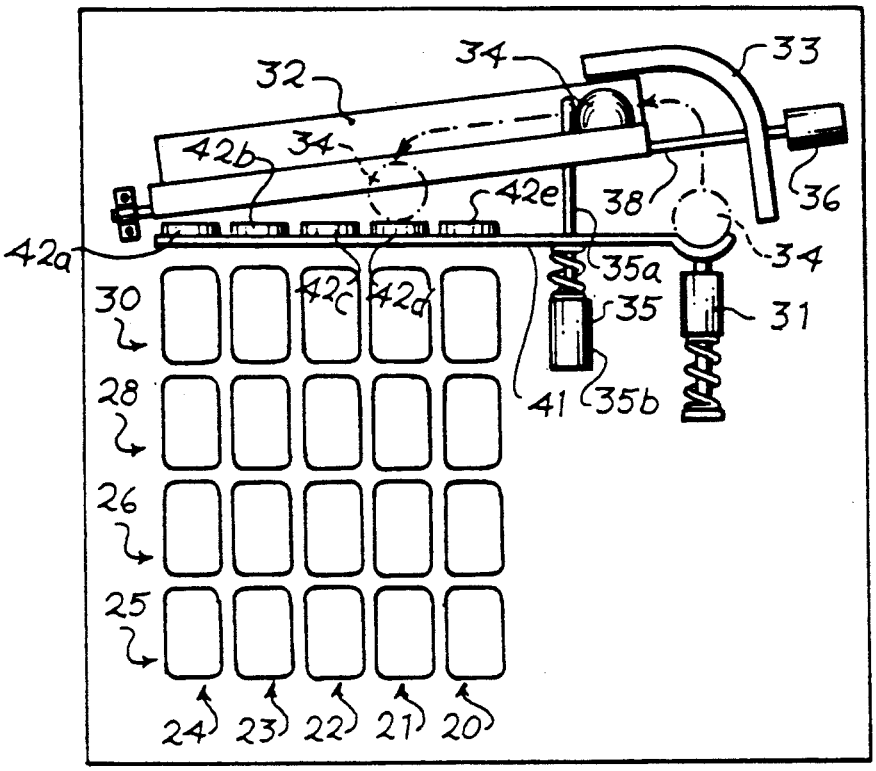
FIG. 2 illustrates a view through lines 2—2 in FIG. 1 illustrating the embodiment of FIG. 1 in greater detail.
Figure 3:
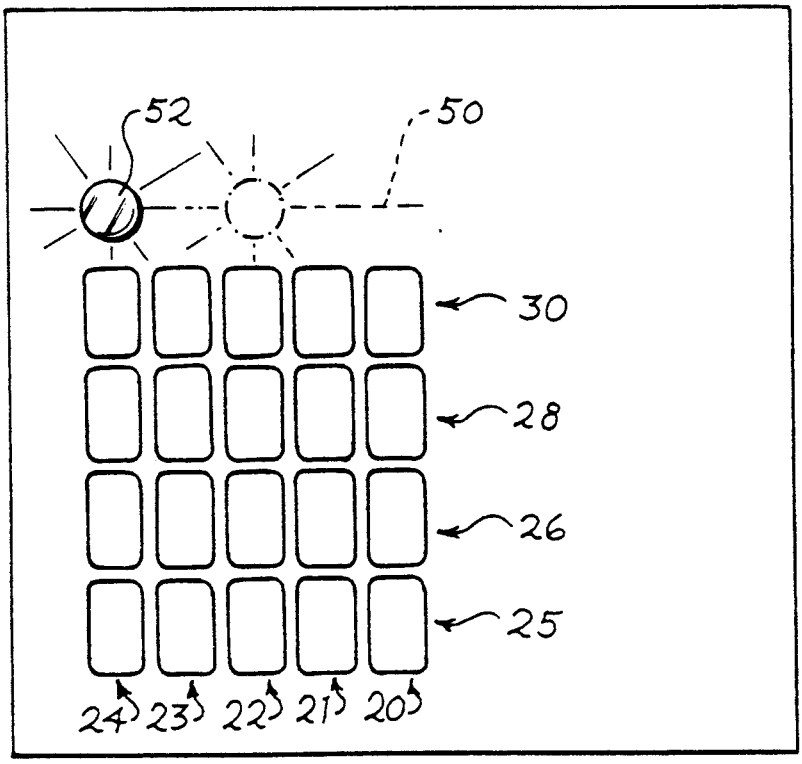
FIG. 3 illustrates a second embodiment of the present invention where the ball is simulated using lights.

Referring now specifically to FIGS. 1-3, a pinball game 10 is illustrated embodying the present invention. The pinball game 10 includes flippers **16*a* and 16*b* which are used to propel the ball on the playing surface 12 of the pinball game. Flipper button 18 is used to operate the flipper 16*a*. It will be appreciated by those skilled in the art that a similar flipper button 18 is preferably located on the other side of the pinball game to operate flipper 16*b*. In this manner, the flippers 16*a* and 16*b* can be individually controlled by the button on the respective side of each flipper. It is also possible for either flipper button to operate both flippers 16*a* and 16*b* simultaneously. The operation and construction of the flippers and the flipper buttons 18** is well known in the art and therefore no further description of the construction or operation is given here.

In the embodiment illustrated in FIGS. 1-3, the pinball game operates in two modes. In the first mode of operation, the pinball game operates like a conventional pinball game. As with conventional pinball games one or more bumpers 15 are disposed on the playing surface 12. The bumper 15 includes a mechanism for propelling the pinball 19 upon contact of the pinball 19 with the bumper 15. It will be appreciated that in some embodiments, the player may also accumulate points when the ball 19 engages the bumper 15. Targets 17 are also provided on the surface 12. The player places the pinball 19 in play by using a spring-biased plunger (not shown). The player accumulates points when the ball 19 engages one of the targets 17.

In this embodiment, the pinball game 10 is configured such that when a certain predetermined bumper 15 or target 17 is engaged by the pinball 19, the pinball game 10 goes into a second mode of operation. In this second mode, a second scoring mechanism is used by the player. The second scoring mechanism is provided in the backbox 14 of the pinball game. As illustrated in FIGS. 1 and 2, the scoring mechanism for this second mode is provided with a row or array of targets each having different game attributes. In the embodiment illustrated, the array or matrix of targets comprises rows 26, 28, 30 and columns 20–24 of poker cards. The face value of each card comprises a different attribute. The cards may be painted on a board or on the glass of the backbox 14 or alternatively may be formed by other displaying technique such as a dot matrix display.

A ball 34 is first positioned above a positioning mechanism 31, such as a ball popping mechanism. The ball popping mechanism 31 projects the ball 34 upwardly such that it engages a guide 33. The guide 33 is configured to guide the ball 34 such that the ball 34 will land on a rail or track 32 after it has projected by the ball popping mechanism 31.

In the illustrated embodiment, the ball 34 is a different ball than the pinball 19 used in the first mode. It will be recognized that it is possible to provide a mechanism which will transfer the pinball 19 from the surface 12 to the backbox 14. In such an alternative embodiment, the same ball would be used for the conventional pinball play and for the second scoring mechanism.

The rail or track 32 may be any suitable means for holding a ball such that the ball rolls downwardly. The rail or track 32 may comprise, for example, a bar which is sloped downwardly as shown in FIG. 2. In this embodiment the bar 32 is rotatable between a first position and a second position. In the first position, the bar 32 is disposed at an angle such that a guide on which ball 34 rolls is defined between the bar 32 and the glass 13 of the backbox 14. The bar 32 is selectively rotated by the player to a second position where the ball drops off of the bar 32. To this end, a solenoid 36 is provided and connected to the bar 32 via a rigidly connected rod 38. When the solenoid 36 is actuated, it rotates the connecting bar 38 and thus the bar 32 to the second position. When the bar 32 rotates such that the ball is no longer supported on the bar 32 the ball 34 falls (as illustrated in phantom) thereby passing or engaging one of sensors **42*a*–42*e* (sensor 42*d* in the illustrated Figure). The solenoid 36 is operatively connected to the flipper button 18 such that when the flipper button 18 is pushed by the player the bar 32** will be rotated thus releasing the ball downwardly.

A ball stopping mechanism 35 is preferably provided to hold the ball 34 in the top position of the bar 32 until the start of the second mode of operation. The ball stopping mechanism 35 includes a bar **35*a* which projects upwardly above the bottom portion of the bar 32 in order to stop the ball 34 from rolling downwardly on the track after it has been positioned on the track by the ball popping mechanism 31 and guide 33. An actuation mechanism, such as a solenoid 35*b*, is provided to move the stopping bar 35*a*** downwardly thereby freeing the ball to roll on the track.

In one preferred embodiment, the ball stopping mechanism 35 is actuated by the player using the flipper button 18. The flipper button 18 is connected such that it actuates the solenoid **35*b* to move the ball stopping bar 35*a* downwardly. Alternatively, the ball stopping bar 35*a* may be actuated automatically by a microprocessor after a certain predetermined time period or after a certain target or bumper on the playing surface 12 has been hit by the pinball 19**.

As illustrated in FIG. 2, a plurality of sensors **42*a*–42*e* are provided below the bar 32. Each of the sensors 42*a*–42*e* correspond to one of the columns 20–24** of poker cards.

The sensors **42*a*–42*e* detect the passage of the ball over one of the columns 20–24. The sensors 42*a*–42*e* may be any suitable means for detecting passage of the ball 34. For example, the sensors 42*a*–42*e* may be mechanical switches which are actuated by engagement of the ball 34 with the switch. Alternatively, the sensors 42*a*–42*e*** may be optical sensors, magnetic sensors or other suitable detecting means.

A second downwardly sloped surface or ramp 41 is provided to return the ball 34 to the ball positioning mechanism 31.

In one embodiment, one of the rows 25, 26, 28, 30 in the array is preselected such that only one of the cards in the matrix or array will be actually selected by the player. That is, the row will be preselected (as described in more detail below) and the column will be selected depending on which column the ball 34 is dropped over. Thus, only one of the cards or targets in the array will actually be selected. The value of the card which is selected is then stored in a memory 37.

The row may be selected in various ways. For example, the row may be selected at random by a central processing unit (CPU) prior to entering the second mode of operation of the pinball game 10. Alternatively, there may be targets or bumpers positioned on the surface 12 of the pinball game which will select one of the rows 25, 26, 28, 30 or change a previously selected row to another row when that certain target or bumper is engaged.

As discussed above, the pinball game 10 preferably includes a CPU which includes a processor such as a microprocessor 27 and a memory 37. The microprocessor 27 and memory 37 are used to operate the conventional features of the pinball game 10 in a manner known in the art. For example, the microprocessor 27 is used to add points to the player's score when the pinball 19 hits one of the targets 17 or bumpers 15. Since these types of conventional features are known in the art no further details are given here.

In the illustrated embodiment, the microprocessor 27 and memory 37 are also used to move the pinball game 10 from the first mode of operation to the second mode of operation and to operate the pinball game 10 in the second mode.

In the second mode the microprocessor 27 may be used, for example, to randomly select the row of cards (as described above). Additionally, the microprocessor 27 is operatively connected to receive the signals from the sensors and to store in memory 37 the value (attribute) of each card in the array which has been selected by the player each time the ball 34 is dropped. The memory is also used to store the various combinations of cards (i.e. a pair, full house, flush, etc.) and a point value associated with each combination. The microprocessor 27 is programmed to: 1) play in the second mode until the player selects a predetermined number of cards: 2) store in and retrieve from the memory 37 the values of the cards; 3) determine the point value for each particular combination from the memory 37; and 4) add that point value to the player's score.

The memory 37 may be any suitable memory device. For example, the memory may comprise a commercially available random access memory (RAM) or a RAM and a read only memory (ROM) or an erasable programmable read only memory (EPROM) in which the combinations and point values are stored in.

The player may thus use the mechanism to drop the ball 34 a predetermined number of times. After each time the ball 34 is dropped, the value of the card which is selected is stored in the memory 37. After the certain predetermined number of cards have been selected, the microprocessor 27 determines the point value of the combination. For example, in the embodiment illustrated, the player may drop the ball 34 five times to select five cards to form a poker hand. The microprocessor 27 then determines whether the player has selected pairs, three-of-a-kind, etc. A table stored in the memory 37 then attributes a predetermined number of points to the player based on which combination the player has been able to obtain.

It will be recognized by those skilled in the art that other embodiments for the various components of the invention illustrated in FIGS. 1 and 2 may be used within the spirit of the invention. For example, instead of providing a display in the form of an array or matrix of cards as illustrated in FIGS. 1 and 2, a display providing a single row but which has the ability to change the cards in the row may provided. An example of such a display is a dot matrix display (not shown). Such a dot matrix display would provide five different cards in a row which are generated by the microprocessor 27. After each time the ball returns to the ball propelling mechanism 31, the microprocessor 27 would generate a new row of cards.

Figure 4:
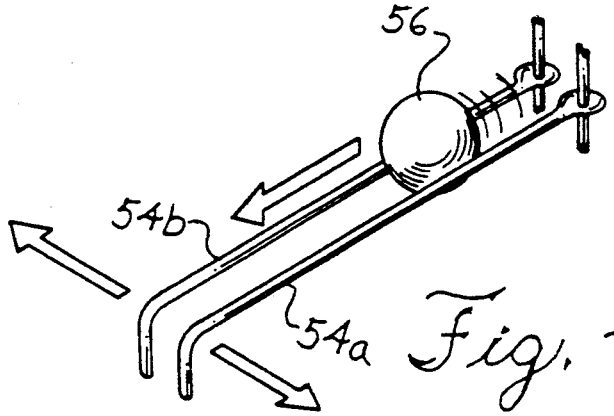
FIG. 4 illustrates another embodiment for a ball dropping mechanism.

Additionally, other track mechanisms on which the ball 34 will roll may be provided. One alternative embodiment is illustrated in FIG. 4. In this embodiment, a pair of rods 54*a* and 54*b* define a track on which a ball 56 rolls. The rods 54*a* and 54*b* are pivoted apart from each other at one end (as indicated by the arrows) until the space between the bars is wider than the ball 56 thereby dropping the ball off of the track. The player would select the point at which the bars 54*a* and 54*b* are pivoted by using the flipper button 18 to actuate the pivoting of the rods 54*a* and 54*b*.

In yet another embodiment illustrated in FIG. 3, a display is provided for simulating a ball 52 which travels along a path 50. The display may be any suitable means for simulating the movement of a ball such as lights or a dot matrix display.

Figure 5:
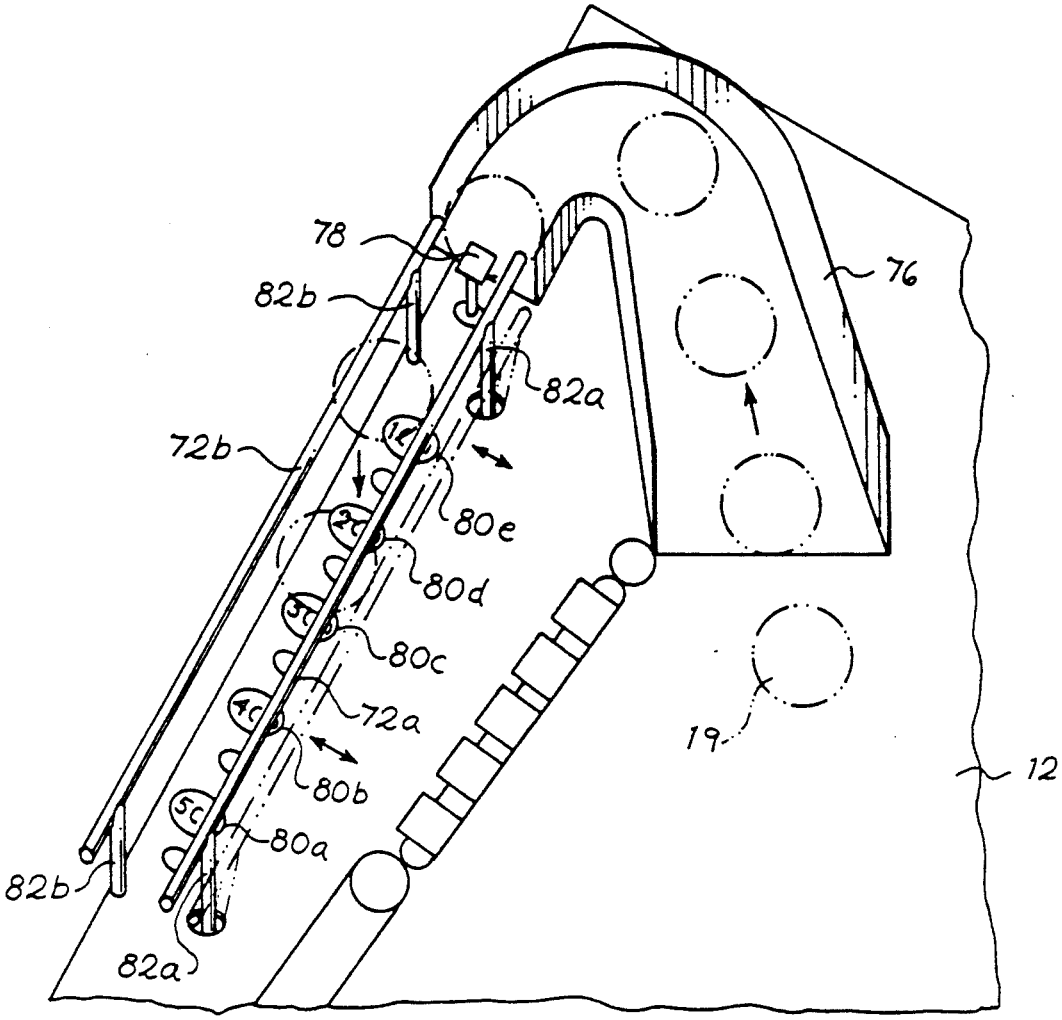
FIG. 5 illustrates another embodiment of the present invention using the ball dropping mechanism of FIG. 4.
Figure 6:
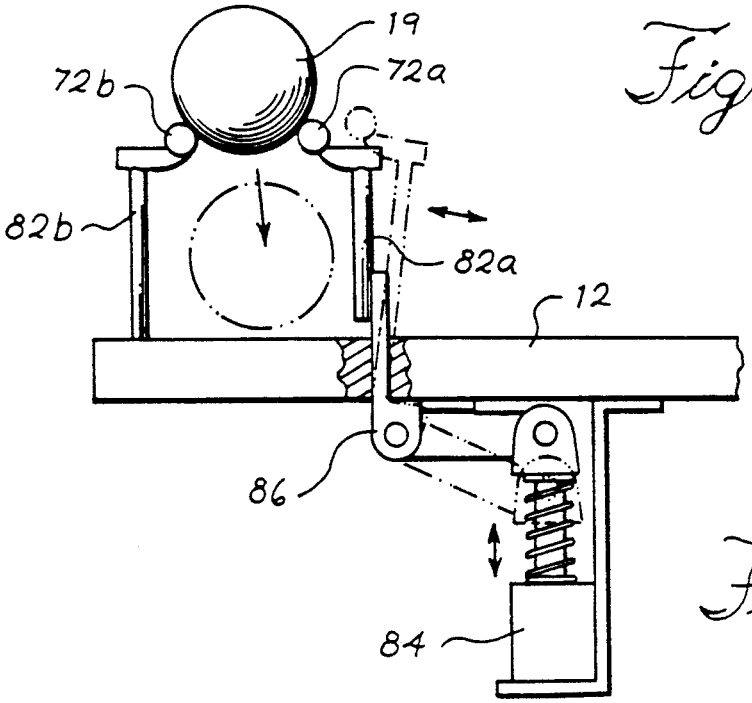
FIG. 6 shows a front view of the embodiment of FIG. 5 including the actuation mechanism.

Referring now to FIGS. 5 and 6, another embodiment of the present invention is illustrated. In this embodiment, the second scoring mechanism is disposed on the playing surface 12 itself. The second scoring mechanism includes a guide 76 which guides the pinball 19 to a ball stopping mechanism 78. The ball stopping mechanism 78 projects above the guide to hold the ball 19 in position until the second scoring mechanism is to be used. The ball stopping mechanism may be actuated automatically by the microprocessor 27 or by the player using one of the flipper buttons depending on the particular configuration contemplated. The second scoring mechanism includes rails 72*a* and 72*b* on which the ball 19 will roll when the rails are in a first position as illustrated in FIG. 6. One of the rails, for example rail 72*a* is pivotally mounted such that the rails may be spread apart (as indicated by the arrows and the rail in phantom lines). A plurality of targets 80*a*–80*e* each having different point values are disposed below the rails 72*a* and 72*b*. The player attempts to drop the ball by pressing the flipper button which actuates a solenoid 84 to pivot rail 72*a* and drop the ball above the target with the highest score.

The rails 72*a* and 72*b* are supported on the playing surface by arms 82*a* and 82*b* respectively. As illustrated in FIG. 6, a solenoid 84 and linkage 86 are used to pivot the arms 82*a* and thus the rail 72*a* upon actuation of the flipper button.

The invention may be embodied in forms other than those specifically disclosed herein without departing from its spirit or essential characteristics. The described embodiments are to be considered in all respects only as illustrative and not restrictive, and the scope of the invention is intended to be commensurate with the appended claims and all equivalents rather than the foregoing detailed description.

I claim:

1. A pinball game comprising:

a ball;

a plurality of visual targets, each target having a representative game attribute;

a track positioned above a plurality of sensors, each sensor being associated with a respective target; said track having a first position wherein said ball rolls on said track and a second position wherein said ball rolls off said track;

a ball positioning mechanism for positioning said ball onto the track;

a player actuation button that causes movement of said track from said first position to said second position dropping the ball off the track into detecting engagement with one of the sensors;

memory means including a first and second set of memory locations, the memory means operatively connected to receive a signal from the sensors and store each game attribute associated with each engaged sensor in the first set of memory locations; and said second set of memory locations having stored therein combinations of said game attributes and points associated with each combination.

2. The pinball game of claim 1 wherein said track slopes downwardly thereby defining an upper end and a lower end and comprises a rotatably mounted bar which rotates from said first position to said second position in response to the actuation button.

3. The pinball game of claim 1 further comprising a movable ball stop at the upper end of the track, the movable ball stop having a first position preventing the ball from rolling on the track and a second position allowing the ball to roll on the track.

4. The pinball game of claim 3 wherein the ball stop is moved from said first position to said second position automatically.

5. The pinball game of claim 3 wherein the ball stop is moved from said first position to said second position in response to the actuation button.

6. The pinball game of claim 1 wherein said game attributes are arranged in horizontal rows and vertical columns and said sensors are positioned above each vertical column.

7. The pinball game of claim 6 further comprising a means for selecting a particular horizontal row of game attributes prior to selecting a vertical column.

8. The pinball game of claim 1 wherein said ball positioning mechanism is positioned below the upper end of the track and projects the ball up onto said first track.

9. The pinball game of claim 1 wherein said track comprises a first bar, and the pinball game further comprises a second track disposed below said first bar; said second track conveying the ball to the ball positioning mechanism after the ball moves from said first position to said second position.

10. A pinball game comprising:

a playing surface;

a ball;

a plurality of targets defining a first set of pinball targets, said targets disposed on said playing surface;

at least one player actuated flipper disposed on the playing surface for propelling the ball;

a track disposed above said playing surface, said track having a first position wherein said ball rolls on said track and a second position wherein said ball rolls off said track;

means for positioning the ball onto the track;

at least one track associated target having a representative game attribute, the at least one track associated target disposed below the track;

a sensor connected to said at least one track associated target to detect engagement of the ball with the at least one track associated target;

a player actuation button that causes movement of said track from said first position to said second position dropping the ball off the track into detecting engagement with the sensor; and memory means for storing a point value for each respective game attribute.

11. A method for playing a pinball game comprising the steps of:

providing a track, the track having a first position wherein a ball rolls on said track and a second position wherein said ball rolls off said track;

rolling a ball across the track;

providing a row of sensors associated with respective game attributes below said track;

actuating the track from the first position to the second position as the ball rolls above a selected game attribute;

storing each selected game attribute associated with each engaged sensor in a memory means;

combining the stored game attributes associated with each sensor;

computing points from a particular combination of game attributes; and adding the points from the combination to a player's score.

12. A method for playing a pinball game comprising the steps of:

playing in a first playing mode and playing in a second playing mode;

the first playing mode comprising the steps of;

providing a playing surface;

providing a ball for the first playing mode;

providing a plurality of targets for engagement with the ball on said playing surface;

providing at least one flipper disposed on said playing surface for propelling said ball on the playing surface;

accumulating a score corresponding to the number of targets engaged;

the second playing mode comprising the steps of:

providing a ball for the second playing mode;

providing a track, said track having a first position wherein said ball rolls on said track and a second position wherein said ball rolls off said track;

providing at least on target disposed below the track;

rolling said ball on the track;

moving said track from said first position to said second position dropping the ball off the track onto said target;

accumulating a score corresponding to the number of targets engaged in the second playing mode; and adding the score accumulated in the second playing mode to the score accumulated in the first playing mode.

* * * * *